United States Patent [19]

Yamada

[11] Patent Number: 4,862,179

[45] Date of Patent: Aug. 29, 1989

[54] SATELLITE RECEIVER

[75] Inventor: Tsuneo Yamada, Tokyo, Japan

[73] Assignee: Trio Kabushiki Kaisha, Tokyo, Japan

[21] Appl. No.: 309,995

[22] Filed: Feb. 13, 1989

Related U.S. Application Data

[63] Continuation of Ser. No. 110,540, Oct. 20, 1987, abandoned, which is a continuation of Ser. No. 841,618, Mar. 20, 1986, abandoned.

[30] Foreign Application Priority Data

Mar. 26, 1985 [JP] Japan ..... 60-42364[U]
Mar. 26, 1985 [JP] Japan ..... 60-42365[U]

[51] Int. Cl.[4] ..... H01Q 3/08

[52] U.S. Cl. ..... 342/359; 342/356; 342/426; 343/766

[58] Field of Search ..... 342/352, 355, 356, 359, 342/422, 426; 343/703, 713, 766

[56] References Cited

U.S. PATENT DOCUMENTS 4,030,099 6/1977 Valenti et al. ..... 342/426
4,796,032 1/1989 Sakurai et al. ..... 342/359
4,801,940 1/1989 Ma et al. ..... 342/359

OTHER PUBLICATIONS

"STV: Satellite Television Magazine", (1/85): Ad for Satellite Technology Servies MBS-AA Antenna Actuator System.

*Primary Examiner*—Thomas H. Tarcza
*Assistant Examiner*—Bernaar Earl Gregory
*Attorney, Agent, or Firm*—Gerald J. Ferguson, Jr.

[57] ABSTRACT

A satellite receiver which selects one of radio waves from a plurality of satellites and receives the selected radio wave. This receiver comprises; a satellite number designation switch; an antenna controller for allowing a parabola antenna to face the designated satellite in accordance with the designation by the designation switch; a memory to store the data corresponding to a correction amount of the position of a probe for each satellite; a drive motor to drive the probe to the position corresponding to the data outputted from the memory; and a control circuit to allow the data for the satellite designated by the designation switch to be supplied from the memory to the drive motor. The probe position is corrected in accordance with the designated satellite.

4 Claims, 6 Drawing Sheets

SATELLITE RECEIVER

This application is a continuation of Ser. No. 07/110,540, filed 10/20/87, now abandoned, which itself was a continuation of Ser. No. 06,841,618 filed Mar. 20, 1986, now abandoned.

BACKGROUND OF THE INVENTION

1. Field of the Invention

The present invention relates to a satellite receiver which selects one of radio waves from a plurality of satellites and receives the television signal or the like and, more particularly, to a satellite receiver in which there is no need to adjust the feed horn to each satellite.

2. Description of the Related Art

There is a satellite receiver which receives the radio waves such as television signals or the like from a plurality of satellites. In such a satellite receiver, the position of the probe of the feed horn is adjusted in the following manner. Namely, for example, as shown in FIG. 1, a monostable multivibrator (MMV) 2 is triggered by a pulse which is outputted from an oscillator 1. A width of an output pulse of the MMV 2 is set by a resistance value of a resistor 3. The output pulse from the MMV 2 is supplied to a servo circuit 4 and converted to the voltage corresponding to the input pulse width by the servo circuit 4. This voltage is compared with the feedback voltage corresponding to an angle of rotation of a servo motor 5, which will be explained later, and the servo motor 5 is driven due to the output of the servo circuit 4. A probe 6 is driven by the servo motor 5 so as to be located at the position corresponding to the output pulse width of the MMV 2, thereby controlling the position of the probe 6.

However, when the satellite adapted for reception is selected, the parabola antenna is driven to the position suitable to accurately face the selected satellite. However, the satellite does not always exist at the normal position but it is generally slightly deviated from the normal position. Therefore, to accurately receive the vertical or horizontal polarized wave of the signal, the vertical and horizontal positions of the probe must be adjusted in accordance with the selected satellite, respectively.

Consequently, there is the problem such that it is troublesome to finely adjust the position of the probe for every satellite.

SUMMARY OF THE INVENTION

The present invention is made in consideration of the above-mentioned point and it is an object of the invention to provide a satellite receiver in which the probe position corresponding to the satellite is stored for every satellite and when the satellite is selected, the probe is controlled to the position corresponding to the selected satellite, thereby eliminating the above problem.

A satellite receiver according to the present invention comprises: designating means for designating a satellite to be received; antenna control means for allowing an antenna to face the designated satellite in accordance with an instruction by the designating means; memory means for storing the data corresponding to a correction amount of position of a probe of a feed horn for each satellite; driving means for driving the probe to the position corresponding to the data which is outputted from the memory means; and control means for allowing the data regarding the satellite designated by the designating means to be supplied from the memory means to the driving means.

According to the satellite receiver constituted as described above, when the satellite is designated by the designating means, the antenna is driven by the antenna control means to the position so as to face the designated satellite. On the other hand, the data for the satellite designated by the designating means is supplied by the control means to the driving means from the memory means. Thus, the position of the probe is corrected to the position corresponding to the data stored in the memory means for the satellite designated by the designating means.

Therefore, when the satellite to be received is selected as well, there is no need to individually adjust the position of the probe. In addition, by setting the memory data in the memory means so as to represent the optimum probe position for each satellite, the radio wave from the satellite can be received in the best condition.

The embodiment of the invention further comprises: position adjustment instructing means for instructing the correction of the probe position; correction amount setting means into which the data corresponding to the correction amount is set in response to a correction instruction of the probe position due to the position adjustment instructing means; control means for allowing the data corresponding to the correction amount set by the correction amount setting means to be stored into the memory means as the data for the satellite designated by the designating means; discriminating means for discriminating whether the correction amount set by the correction amount setting means lies out of a predetermined range or not; and alarm means for warning when it is determined by the discriminating means that the correction amount is out of the predetermined range.

When the correction of the probe position is instructed by the position adjustment instructing means, the correction amount of the probe position is instructed by the correction amount setting means. The data corresponding to the correction amount of the probe position set by the correction amount setting means is stored by the control means into the memory means as the data for the satellite designated by the designating means. As will be obvious from the above description, the control means controls the writing of the data into the memory means.

Therefore, by setting the memory data in the memory means in correspondence to the optimum probe position for each satellite, the radio wave from the satellite can be received in the best condition. Also, when the satellite to be received is selected as well, there is no need to individually adjust the position of the probe.

On the other hand, when the correction amount set by the correction amount setting means is out of a predetermined range, this fact is discriminated by the discriminating means and warned by the alarm means.

DETAILED DESCRIPTION OF PREFERRED EMBODIMENT

Figure 1:
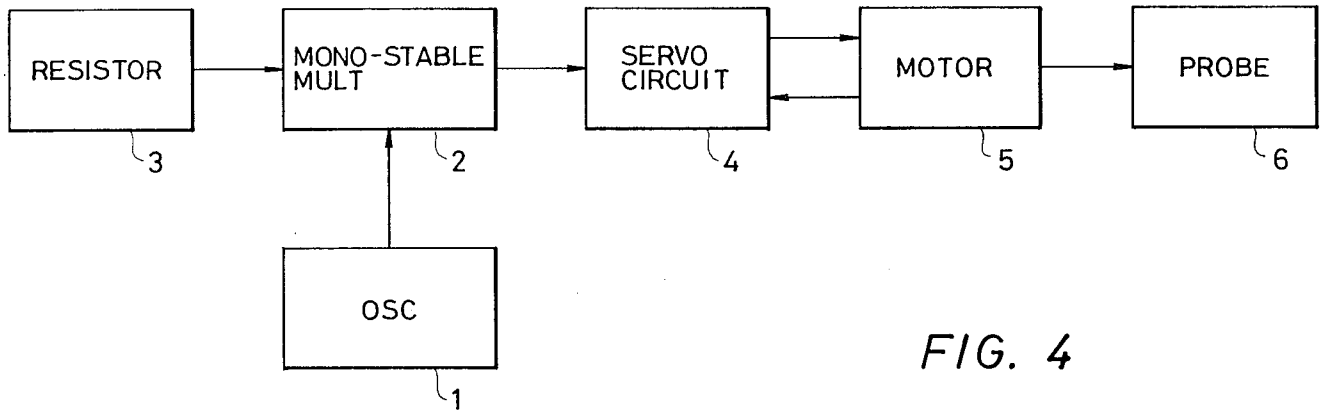
FIG. 1 is a block diagram showing a conventional technology.
Figure 4:
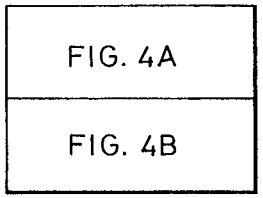
FIGS. 4A and 4B and 5 are flowcharts for explaining the operation of the embodiment of the invention.
Figure 2:
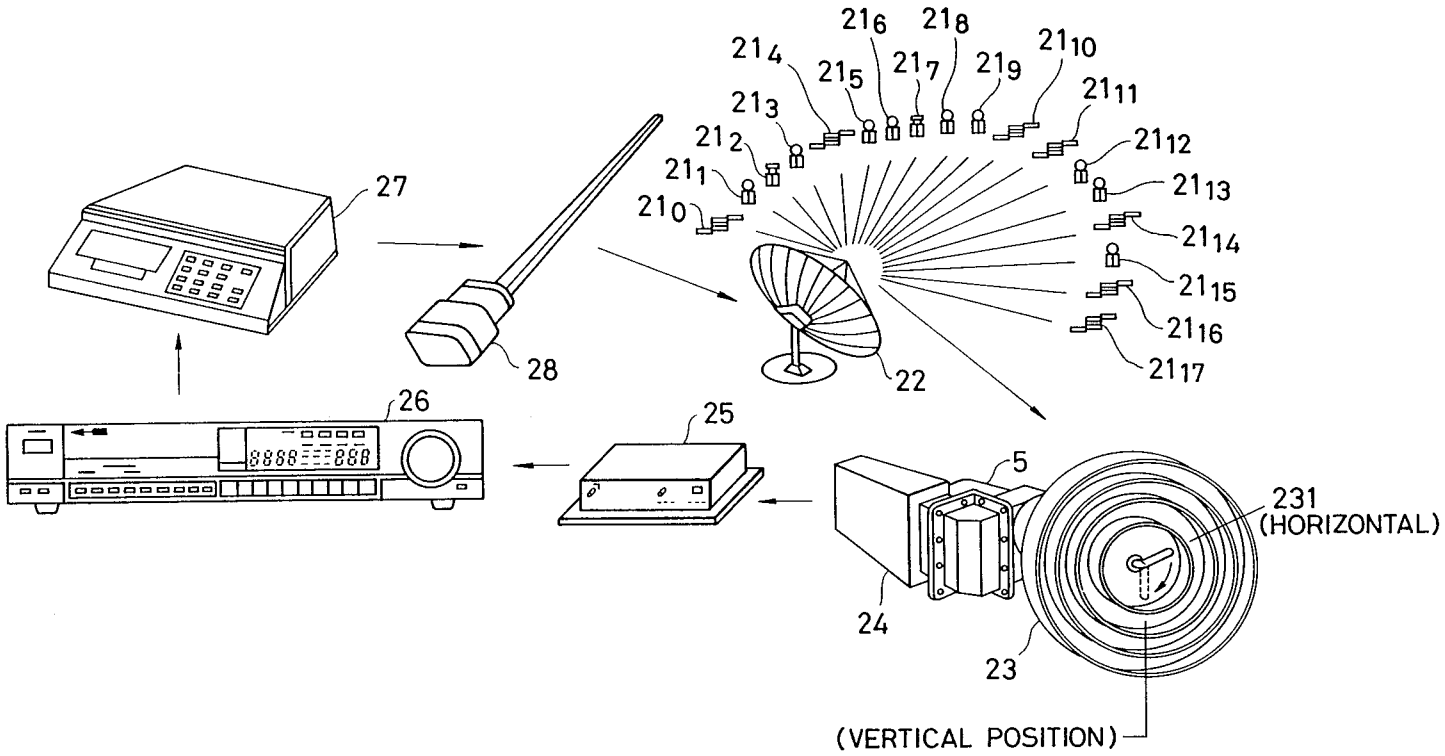
FIG. 2 is a diagrammatical constitutional view illustrating an example of a satellite receiver to which an embodiment of the present invention is applied.

FIG. 2 is a diagrammatical constitutional view illustrating an example of a satellite receiver to which an embodiment of the present invention is applied.

The satellite placed in the geostationary orbit in the equatorial space is equipped with a plurality of transponders and the radio waves in the even and odd channels are alternately horizontally and vertically polarized to avoid disturbance of the adjacent channels.

The radio waves from satellites $21_0$ to $21_{17}$ are received by a parabola antenna 22 and supplied to a low noise amplifier 24 through a feed horn 23 and then amplified. The amplified output of the amplifier 24 is converted to the signal of the frequency of, e.g., 1 GHz by a block down converter 25 and supplied to a receiver 26 and received.

On the other hand, numeral 27 denotes an antenna controller. The antenna controller 27 receives the designated data from the receiver 26 and can drive the parabola antenna 22 in the directions of east and west through an actuator 28. The antenna 22 is driven to the position so as to face the satellite corresponding to the designated data from the receiver 26, so that the satellite is selected.

The position of probe 231 of the feed horn 23 is controlled on the basis of the width of control pulse from the receiver 26. The probe position is controlled by the probe drive motor 5 in correspondence to the horizontally and vertically polarized waves Although FIG. 2 shows the arrangement such that the feed horn 23 and actuator 28 are integrally constituted in the parabola antenna 22, they are illustrated as the separate parts for convenience of explanation.

Figure 3:
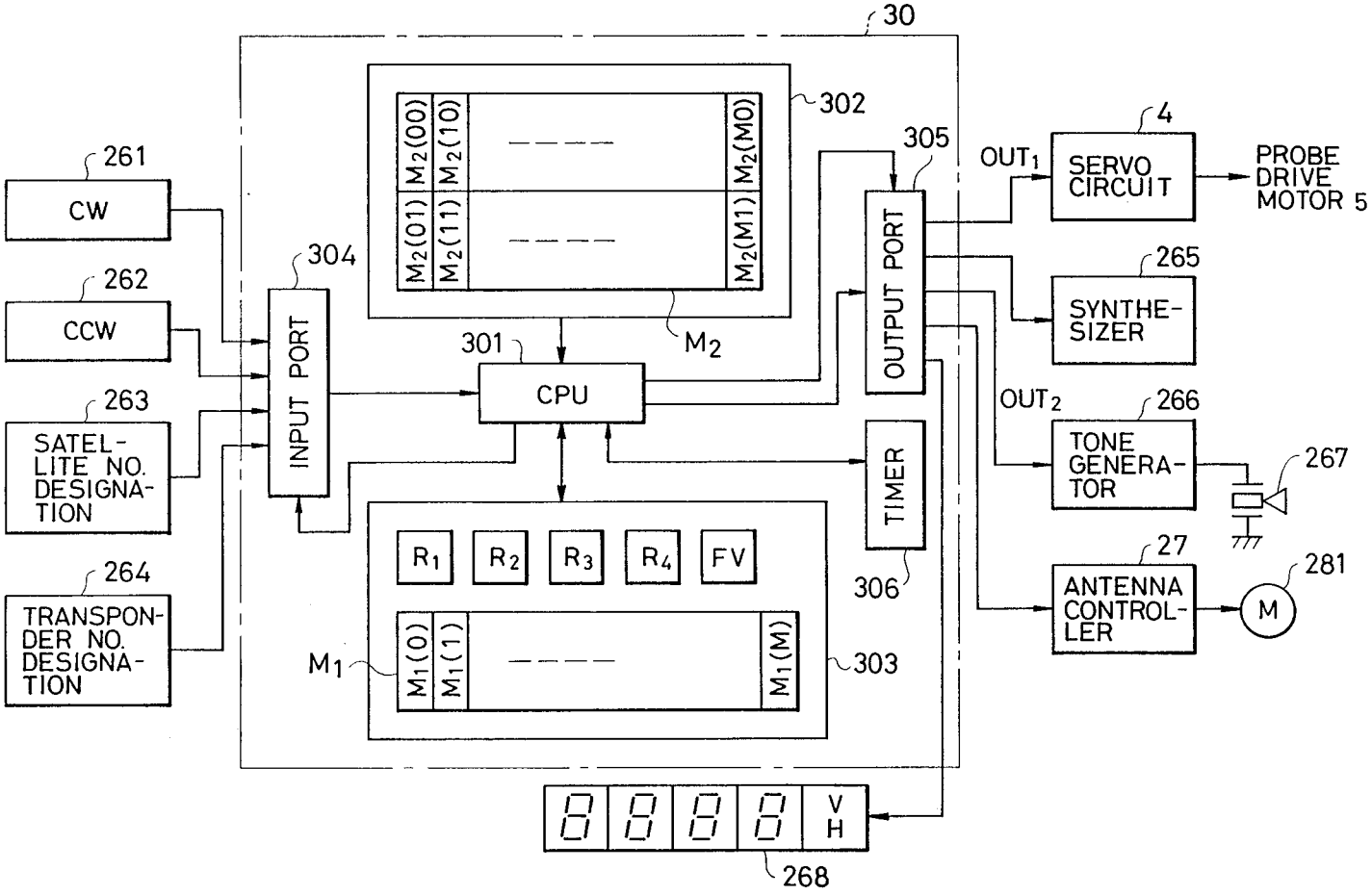
FIG. 3 is a block diagram showing an arrangement of the embodiment of the invention.

The receiver 26 is provided with a control unit 30 which outputs selection data and a control pulse to drive the probe of the feed horn 23 to the antenna controller 27. The section regarding the control unit 30 of the receiver 26 is constituted as shown in a block diagram of FIG. 3.

The control unit 30 consists of a microcomputer and essentially comprises a CPU 301; a ROM 302 in which programs are stored; a RMM 303 to store data; an input port 304; an output port 305; and a timer 306. In addition to the programs, the data (M, 0) [m=0, . . . , M] corresponding to each satellite and the data (m, 1) to discriminate whether the polarized wave of the even number transponder of the satellite is the vertical polarized wave or not in correspondence to the satellite are stored into the ROM 302 as a format of two-dimensional table. These data are indicated at $M_2$ in FIG. 3. "1" is stored as data (m, 1) in the case of the even number polarized wave. The RAM 303 has memory areas $R_1$, $R_2'$, $R_3$, $R_4$, and $M_1$, and a flag area FV. The memory area $R_1$ serves to store the data corresponding to the width of the control pulse to control the probe position. The memory area $R_2$ serves to store the data corresponding to time $T_1$ necessary to drive the probe in the whole movable range. The memory area $R_3$ serves to store the data corresponding to the selected satellite. The memory area $R_4$ serves to store the data corresponding to the selected transponder. The flag area FV is set in the case of the vertically polarized wave. The memory area $M_1$ serves to store the data corresponding to the fine adjustment control pulse width necessary for each satellite, respectively.

A position adjustment instruction switch 261 serves to instruct the clockwise rotation to the probe. A position adjustment instruction switch 262 serves to instruct the counterclockwise rotation to the probe. A satellite number designation switch 263 is composed of, for example, ten-key and serves to designate the number corresponding to the selected satellite. A transponder number designation switch 264 serves to designate the number of the selected transponder. The outputs of those switches 261 to 264 are supplied to the input port 304, through which they are read into the CPU 301 in accordance with the programs stored in the ROM 302. Those outputs are subjected to the processes such as comparison, calculation, and the like by the CPU 301. The outputs from the CPU 301 are supplied through the output port 305 in accordance with the programs stored in the ROM 302 in the following manner. Namely, the control pulse output is supplied to the servo circuit 4. The control data to select the frequency of the selected transponder and allow the signal of this selected frequency to be received is supplied to a frequency synthesizer 265. The signal to allow an alarm sound to be generated from a speaker 267 is supplied to a tone generator 266. The designation data to designate the position of the parabola antenna 22 is supplied to the antenna controller 27. The number corresponding to the selected satellite, the number corresponding to the selected transponder, and the signals representative of the (horizontal and vertical) directions of the polarized waves are supplied to an indicator 268. Reference numeral 281 denotes a motor constituting a part of the actuator 28 and is driven by the antenna controller 27.

The position adjustment instruction switches 261 and 262, satellite number designation switch 263, transponder number designation switch 264, frequency synthesizer 265, tone generator 266, and indicator 268 are provided in the receiver 26. The output of the servo circuit 4 is supplied to the probe drive motor 5.

In the well-known manner, the timer 306 registers the data corresponding to the preset time into, for example, a timer counter, decreases the registered data by one for every pulse which is obtained by dividing the clock pulse of the microcomputer 30, sets the time when the value of timer counter becomes zero to the preset time, and thereby performing the internal interruption.

Figure 4A:
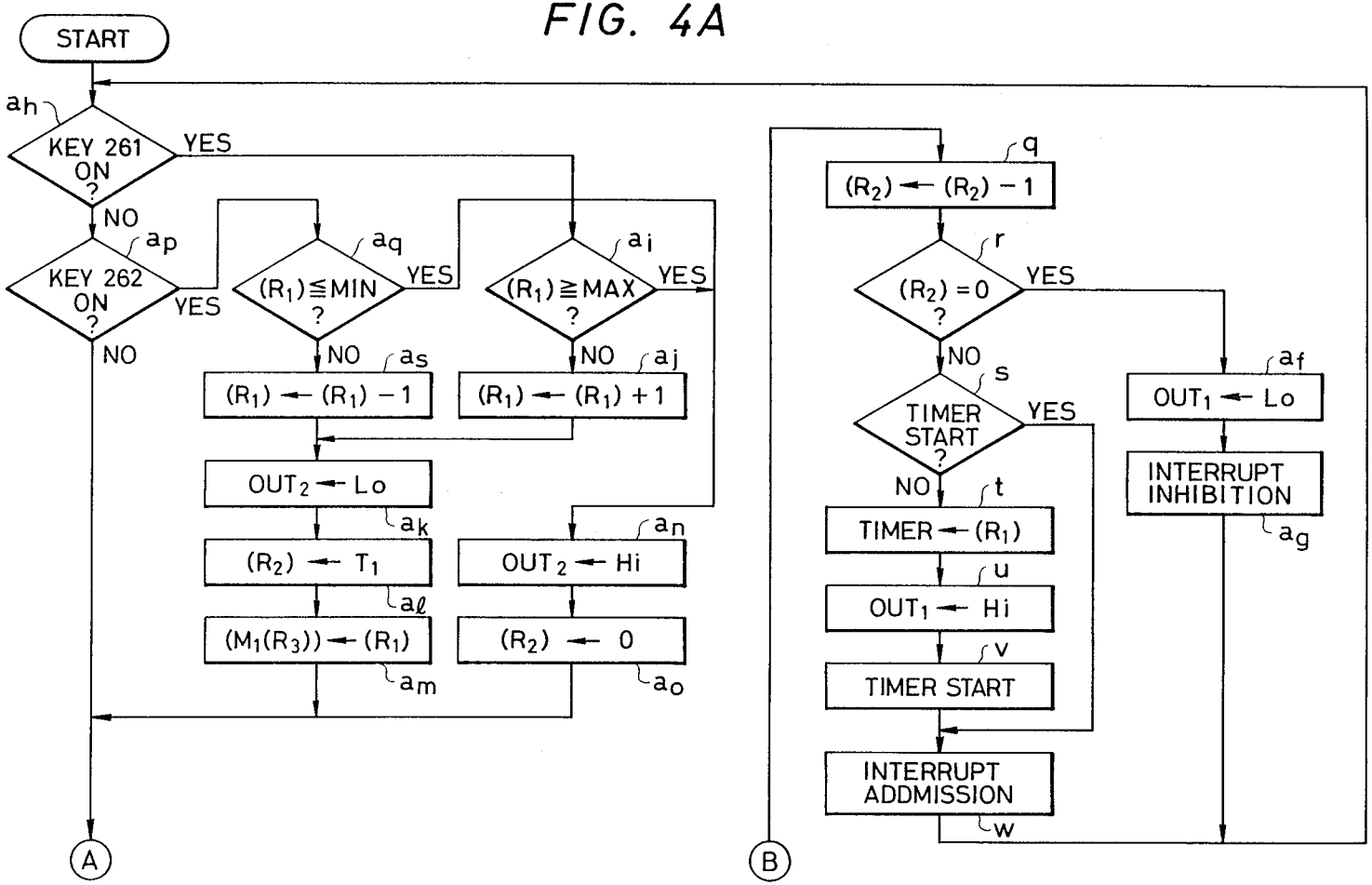
Figure 4B:
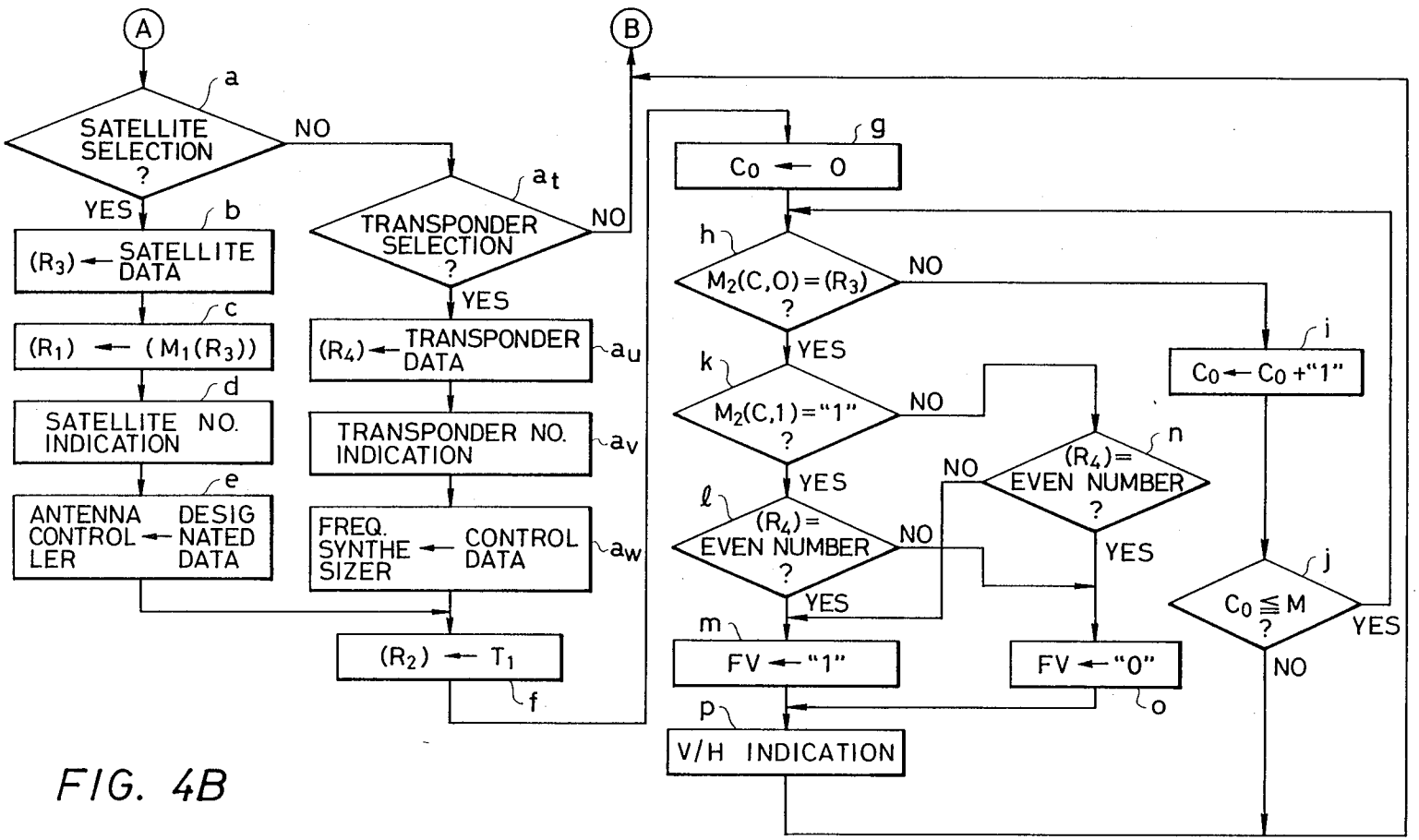
Figure 5:
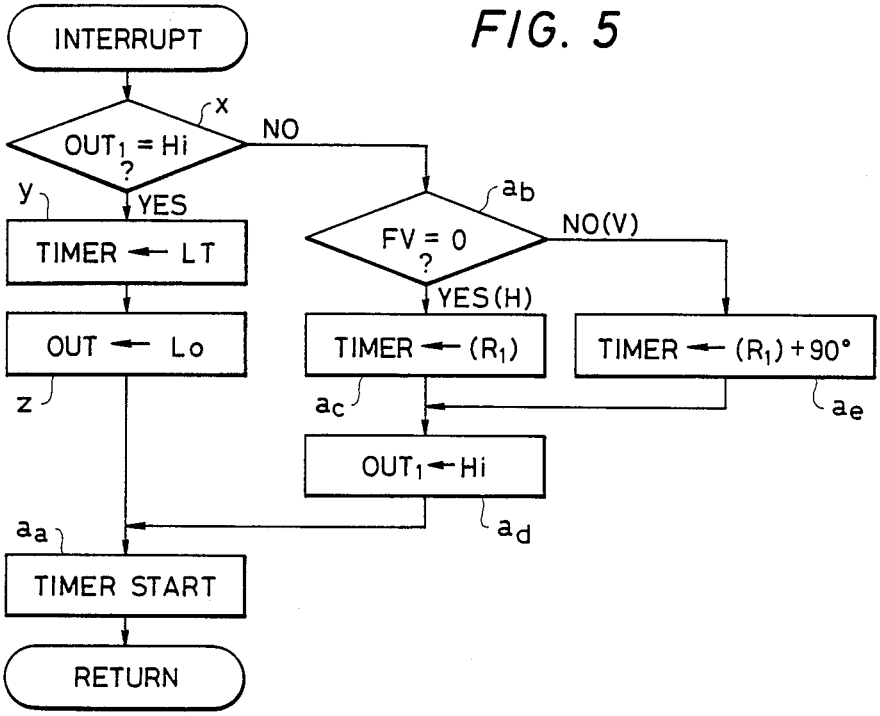

The operation of the invention constituted as mentioned above will then be described on the basis of the programs stored in the ROM 302 with reference to flowcharts shown in FIGS. 4A, 4B, and 5.

When the programs start, the initializations including the clear of the memory area $R_2$ and flag area FV are executed. The receiver waits until the switches 261 to 264 are pressed. Even when the satellite number designation switch 263 and transponder number designation switch 264 are not pressed, the reception corresponding to the memory contents of the memory areas $R_3$ and $R_4$ is realized, namely, the radio wave from the transponder corresponding to the data stored in the memory area $R_4$ of the satellite corresponding to the data stored in the memory area $R_3$ is received. This is because, for instance, the memory content of the RAM 303 is held by the backup power source for the period of time when the power switch is OFF.

When the new satellite is designated by the satellite NO. designation switch 263 (step a), the data corresponding to the designated satellite is stored into the memory area $R_3$ (step b). The memory content ($M_1(R_3)$) of the memory area M is transferred to the memory area $R_1$ (step c). The memory content ($M_1(R_3)$) of the memory area M is the data corresponding to the control pulse width to adjust the probe of the satellite designated in step a. After step c, the data corresponding to the satellite designated in step a is outputted and the designated satellite number is displayed by the indicator 268 (step d). Then, the designated data corresponding to the designated satellite is supplied to the antenna controller 27 (step e). In response to the designated data in step e, the antenna controller 27 drives the motor 281 so that the parabola antenna 22 faces the designated satellite by use of the actuator 28.

After step e, the data corresponding to time $T_1$ is stored into the memory area $R_2$ (step f). Then, "0" is set to an address counter $c_0$ of the ROM 302 (step g). The memory content of the memory area $M_2$ which is equal to the memory content of the memory area $R_3$ is then searched (steps h, i, j). When it is determined in step h that the memory content of the memory area $R_3$ is equal to the memory content of the memory area $M_2$, a value c of the address counter $c_0$ at this time indicates the address of the memory area $M_1$ in which the data corresponding to the satellite designated in step a has been stored.

After step h, a check is made to see if $M_2(c, 1)=1$ or not (step k). Namely, in step k, a check is made to see if the radio wave from the even number transponder of the satellite designated in step a is the vertically polarized wave or not. When $M_2$ (c, 1)=in step h, the radio wave from the even number transponder of the designated satellite is the vertically polarized wave. On the contrary, when $M_2$ (c, 1)$\neq$1, the radio wave from the even number transponder of the designated satellite is the horizontally polarized wave.

When $M_2$ (c, 1)=1 in step h, a check is made to see if the memory content of the memory area $R_4$ is the data corresponding to the even number transponder or not (step l). When $M_2$ (c, 1)$\neq$1 in step h as well, a check is also made to see if the memory content of the memory area $R_4$ is the data corresponding to the even number transponder or not (step n). A check is made to see if the number of transponder from which the radio wave is at present being received is even number or not in steps l and n.

When the memory content of the memory area $R_4$ is the data corresponding to the even number transponder in step l and when the memory content of the memory area $R_4$ is not the data corresponding to the even number transponder in step n, "1" is set to the flag area FV (step m) after steps l and n. On the contrary, if NO in step l and if YES in step n, the flag area FV is reset (step o) after steps l and n. Namely, when the radio wave from the transponder during reception is the vertically polarized wave, "1" is set to the flag area FV. When it is the horizontally polarized wave, the flag area FV is reset. The vertically or horizontally polarized wave is indicated as "V" or "H" by the indicator 268 (step p). Then, the memory content of the memory area $R_2$ is decreased by one (step q). In addition, when the value c of the counter $c_0$ exceeds the maximum address value M of the memory area $M_2$ in step j as well, step q is executed after step j.

Subsequent to step q, a check is made to see if the memory content of the memory area $R_2$ is "0" or not (step r). If YES in step r, this means that the period of the control pulse output for adjustment of the probe position ends.

When the memory content of the memory area $R_2$ is not "0" in step r, a check is made to see if the timer 306 has started timing or not (step s). If NO in step s, the memory content of the memory area $R_1$ is set to the timer counter of the timer 306 (step t). Namely, the preset time is set in step t. Then, a high potential (Hi) output is supplied to the servo circuit 4 (step u). The timer 306 starts timing (step v). The interruption is permitted (step w).

When the timer 306 has started timing in step s, step w is then executed.

After an expiration of the preset time of the timer 306 after step w had been executed, the internal interruption is performed and the interruption routine is executed as will be explained later. When the memory content of the memory area $R_2$ is "0" in step r, the probe has already completely been moved, so that a low potential (Lo) output is supplied to the servo circuit 4 (step af) and the interruption is inhibited (step ag). When the low potential output is supplied to the servo circuit 4, the movement of the probe position is not carried out. In step u, in addition to the supply of the high potential output, the power voltage may be supplied to the servo circuit 4. In step af, in addition to the supply of the low potential output, the supply of the power voltage to the servo circuit 4 may be shut off. Due to this, an amount of electric power consumption can be reduced.

When the new transponder is designated by the transponder NO designation switch 264 (step at), the data corresponding to the designated transponder is stored into the memory area $R_4$ (step au). The data corresponding to the transponder designated in step at is outputted and the number of the designated transponder is displayed by the indicator 268 (step av) After step av, the control data corresponding to the transponder designated in step at is supplied to the frequency synthesizer 265 (step aw). In response to the control data supplied, the frequency synthesizer 265 generates the signal of the frequency corresponding to the frequency of the radio wave from the designated transponder, so that the radio wave from the designated transponder is received. After step aw, steps f to p are executed and the receiver operates in a manner similar to the case where the satellite was selected. In this case, a check is made to see if the radio wave from the newly designated transponder is the vertically polarized wave or horizontally polarized wave and the resultant data is displayed by the indicator 268 in steps k to p.

As described above, the timer 306 starts timing (step v), the interruption is permitted (step w), and the internal interruption is performed after an elapse of the preset time of the timer 306. In this way, the interruption routine starts. Thereafter, a check is made to see if the output to the servo circuit 4 is at a high potential (Hi) level or not (step x). When the output to the servo circuit 4 is at a high potential (Hi) level in step x, the data corresponding to period of time LT is set to the timer counter of the timer 306 (step y) after step x. Then, the low potential (Lo) output is supplied to the servo circuit 4 (step z). Subsequently, the timer 306 starts timing (step aa) and the processing routine is returned to the step immediately before the interruption. If NO in step x, a check is made to see if "0" has been set to the flag area FV or not (step ab). If YES in step ab, the radio wave from the transponder is the horizontally polarized wave, so that the memory content of the memory area $R_1$ is set to the timer counter of the timer 306 (step ac) after step ab. Then, the high potential (Hi) output is supplied to the servo circuit 4 (step ad) and then step aa is executed. On the contrary, when "1" has been set to the flag area FV in step ab, the radio wave from the transponder is the vertically polarized wave, so that the sum of the memory content of the memory area $R_1$ and the data corresponding to 90° is set to the timer counter of the timer 306 (step ae) after step ab and then step ad is executed. In this routine, the horizontally polarized wave is used as the reference wave and in the case of the vertically polarized wave, the data corresponding to 90° is added to the memory content of the memory area $R_1$ and the resultant data is set to the timer counter of the timer 306 as in step ae.

Figure 6:
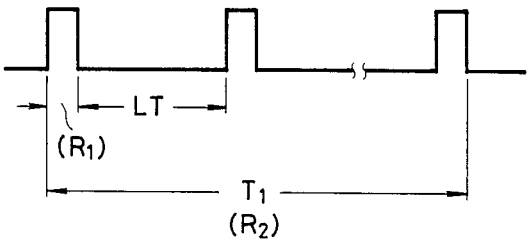
FIG. 6 is a waveform diagram for explaining the operation of the embodiment of the invention.

Therefore, as shown in FIG. 6, the high potential output is supplied to the servo circuit 4 for the period corresponding to the memory content of the memory area $R_1$. Thereafter, the low potential output is supplied to the servo circuit 4 for the period LT corresponding to the data set to the timer counter of the timer 306 in step y. The period when those outputs are supplied becomes the period $T_1$ corresponding to the memory content of the memory area $R_2$. Thus, as shown in FIG. 6, the control pulse of the width corresponding to the memory content of the memory area $R_1$ is supplied to the servo circuit 4 and the probe is adjusted to the position according to the memory content of the memory area $R_1$.

Next, when the position adjustment instruction switch 261 is pressed, this depression is detected in step ah and a check is then made to see if the memory content of the memory area $R_1$ is less than the maximum value to move the probe clockwise or not (step ai). It is now assumed that the control pulse width is widened by pressing the position adjustment instruction switch 261, so that the probe is located at one end when the control pulse width is the maximum value. When the position adjustment instruction switch 262 is pressed, this depression is detected in step ap. Then, a check is made to see if the memory content of the memory area $R_1$ is larger than the minimum value or not (step aq). It is assumed that by pressing the switch 262, the control pulse width is narrowed and the probe is driven counterclockwise. Thus, the probe is located at the other end when the control pulse width is the minimum value.

When the memory content of the memory area $R_1$ is smaller than the maximum value in step ai, the memory content of the memory area $R_1$ is increased by "1" (step aj). When the memory content of the memory area $R_1$ is larger than the minimum value in step aq, the memory content of the memory area $R_1$ is decreased by "1" (step as) after step aq.

On the contrary, when the memory content of the memory area $R_1$ is equal to or larger than the maximum value in step ai, and when the memory content of the memory area $R_1$ is equal to or smaller than the minimum value in step aq, the high potential (Hi) output is supplied to the tone generator 266 and an alarm sound is generated from the speaker 267 (step an) after steps ai and aq. Due to this alarm sound, it is reported that the probe has been moved to the position beyond one end of the movable range or beyond the other end thereof. After step an, the memory content of the memory area $R_2$ is set to "0" (step ao). The receiver waits until the new satellite or transponder is designated (steps a, at). Thus, when the memory content of the memory area $R_1$ is equal to or larger than the maximum value or equal to or smaller than the minimum value, the probe has already been moved to the limit position and an alarm sound is generated to inform this fact. The control pulse is not supplied to the servo circuit 4.

On the other hand, after steps as and aj, the low potential (Lo) output is supplied to the tone generator 266 (step ak). Therefore, in this case, the probe is not moved to the end and no alarm sound is generated. After step ak, the data corresponding to time $T_1$ is stored into the memory area $R_2$ (step a l). Then, the memory content of the memory area $R_1$ is transferred to the address of the memory area $M_1$ corresponding to the selected satellite (step am). After step am, the receiver waits until the new satellite or transponder is designated (steps a, at).

As described above, the operation in the embodiment of the invention will be summarized as follows. When the satellite is designated, the data corresponding to the designated satellite is supplied to the antenna controller 27, so that the parabola antenna 22 is driven to the position so as to face the designated satellite. In addition, a check is made to see if the polarized wave of the radio wave of the transponder which is being selected or was selected is the horizontally polarized wave or vertically polarized wave. The control pulse of the width corresponding to the data stored in correspondence to the selected satellite is outputted, so that the probe is controlled to the position suitable for the selected satellite.

On the other hand, by pressing the position adjustment instruction switch 261, the control pulse width is widened and the probe is clockwise rotated. By pressing the position adjustment instruction switch 262, the control pulse width is narrowed and the probe is counterclockwise rotated. The data corresponding to the position of the probe due to this rotation is stored into the address of the memory area $M_1$ corresponding to the satellite from which the radio wave is at present being received. Thus, the memory content of the memory area $M_1$ can be updated.

In addition, when the control pulse width becomes the maximum value by pressing the switch 261, the pulse width becomes constant and the clockwise rotation of the probe is stopped. Thus, the movement of the probe is stopped and the alarm sound is generated and the supply of the control pulse is stopped. On the contrary, when the control pulse width becomes the minimum value by pressing the switch 262, the pulse width becomes constant and the counterclockwise rotation of the probe is stopped. Thus, the movement of the probe is stopped and the alarm sound is generated and the supply of the control pulse is stopped.

What is claimed is:

1. A satellite receiver for receiving a radio wave signal through a feedhorn, and with a rotatable probe for obtaining mechanical polarization of an antenna which is to be pointed toward a designated satellite, comprising:

a designation means for selectively designating one of a plurality of satellites and for generating a designated satellite code representative of the designated satellite;

a memory means for storing attitude data for each one of said plurality of satellites;

a control means which is responsive to the designated satellite code for reading out the attitude data for the designated satellite from said memory means and being sequentially responsive to the readout attitude data for generating a probe position drive signal during a predetermined interval to rotate the probe to a position corresponding, to the read-out attitude data, the probe position drive signal's form being determined by the read-out attitude data; and a fine adjustment means manually operated to generate a fine adjustment instruction indicative of the position of the probe to obtain satisfactory reception of a polarized signal from the designated satellite, wherein said control means responsive to the fine adjustment instruction updates the attitude data stored in said memory means for the designated satellite by a predetermined amount and sequentially reads out the updated attitude data for the designated satellite from said memory means, and generates an updated probe position drive signal during the predetermined interval to rotate the probe to an updated position corresponding to the readout updated attitude data, the form of the updated probe position drive signal being determined by the read-out updated attitude data.

2. A satellite receiver according to claim 1 further comprising update means for generating an update instruction signal to update the attitude data stored in said memory means, wherein said control means responsive to the update instruction signal updates the attitude data stored in said memory means for the designated satellite by a predetermined amount, reads out the updated attitude data for the designated satellite from updated attitude data, generates an updated probe position signal to rotate an updated position corresponding to the readout updated attitude data.

3. A satellite receiver according to claim 2, wherein said control means repeats the sequence of the update step, read-out step and updated probe position signal generating step until the update instruction signal terminates.

4. A satellite receiver according to claim 1, wherein said probe position drive signal is a toneburst-like waveform with the predetermined interval, the pulse width being determined by the read-out attitude data.

* * * * *